United States Patent [19]

East et al.

[11] Patent Number: 4,610,725

[45] Date of Patent: Sep. 9, 1986

[54] CONTINUOUS EXTRUSION OF METALS

[76] Inventors: John East, 138 Windrush, Highworth, Wiltshire SN6 7DX; Ian Maxwell, 1 St. Anne's Road, Caversham, Reading, Berkshire, both of England

[21] Appl. No.: 574,511

[22] Filed: Jan. 27, 1984

[30] Foreign Application Priority Data

Feb. 3, 1983 [GB] United Kingdom ..... 8302951
Apr. 12, 1983 [GB] United Kingdom ..... 8309836

[51] Int. Cl.[4] ..... B22F 1/00

[52] U.S. Cl. ..... 75/228; 75/245; 75/249; 72/256; 72/257; 72/253.1; 72/262; 72/270; 164/272; 164/418; 164/443; 419/41; 419/67; 425/79

[58] Field of Search ..... 425/79; 72/256, 257, 72/253.1, 262, 270; 419/41, 67; 164/272, 418, 443; 75/228, 245, 249

[56] References Cited

U.S. PATENT DOCUMENTS

| | | | |
|---|---|---|---|
| 3,911,705 | 10/1975 | Voorhes | 72/270 |
| 4,054,048 | 10/1977 | Hagerman | 72/262 |
| 4,055,979 | 11/1977 | Hunter et al. | 72/262 |
| 4,101,253 | 7/1978 | Etherington | 72/262 |
| 4,283,931 | 8/1981 | Pigott et al. | 72/270 |
| 4,362,485 | 12/1982 | Slater et al. | 72/262 |
| 4,419,324 | 12/1983 | Childs et al. | 419/67 |
| 4,552,520 | 11/1985 | East et al. | 425/224 |

*Primary Examiner*—Stephen J. Lechert, Jr.

[57] ABSTRACT

A continuous extrusion machine, in which feedstock is admitted (at 50) to a peripheral groove (12) in a rotating wheel (10), is enclosed in that groove by a cooperating shoe (24), and is frictionally dragged along an arcuate passageway (48) formed by said groove and a projecting portion (30) of said shoe towards an abutment (36) carried by the shoe. The abutment tip and adjacent wheel parts disposed downstream of the abutment are cooled directly by a jet of cooling fluid issuing from a nozzle (64) carried downstream on the shoe. An annular band (FIG. 2, 74) of a good thermally-conductive metal embedded concentrically in the wheel enhances the cooling obtained. The extrusion apparatus yields a metal product (FIG. 5, 102) which is threaded through a treatment die (104) to change its cross-section, and is continuously drawn therethrough by a tensioning device (106,112) under the control of a system which (a) senses the temperature of the product (102) as it leaves the extrusion apparatus (100); (b) converts a temperature signal (120) so produced, in a function generator (124), into a tension reference signal (126); (c) compares with that tension reference signal a tension feedback signal (116) derived from a sensor (118) adjacent the extrusion apparatus; and (d) controls the tensioning device in accordance with the difference of the tension reference and feedback signals so as to prevent the sensed tension in the product extending between the extrusion apparatus (100) and the treatment die (104) from exceeding a safe value which is less than the yield stress tension of that product at the sensed temperature.

29 Claims, 10 Drawing Figures

CONTINUOUS EXTRUSION OF METALS

TECHNICAL FIELD

This invention relates to an apparatus and method for effecting continuous extrusion of metal from a feedstock in particulate, comminuted or solid form, which apparatus includes:

(a) a rotatable wheel member arranged for rotation when in operation by a driving means, said wheel member having formed peripherally thereon a continuous circumferential groove;

(b) a cooperating shoe member which extends circumferentially around a substantial part of the periphery of said wheel member and which has a portion which projects in a radial direction partly into said groove with small working clearance from the side walls of said groove, said shoe member portion defining with the walls of said groove an enclosed passageway extending circumferentially of said wheel member;

(c) feedstock inlet means disposed at an inlet end of said passageway for enabling feedstock to enter said passageway at said inlet end whereby to be engaged and carried frictionally by said wheel member, when rotating, towards the opposite, outlet end of said passageway;

(d) an abutment member carried on said shoe member and projecting radially into said passageway at said outlet end thereof so as to substantially close said passageway at that end and thereby impede the passage of feedstock frictionally carried in said groove by said wheel member, thus creating an extrusion pressure in said passageway at said outlet end thereof; and (e) a die member carried on said shoe member and having a die orifice opening from said passageway at said outlet end thereof, through which orifice feedstock carried in said groove and frictionally compressed by rotation of said wheel member, when driven, is compressed and extruded in continuous form, to exit from said shoe member via an outlet aperture.

BACKGROUND ART

In operating such an extrusion apparatus, the parts defining said passageway adjacent said outlet end thereof suffer very great working loads and very high operating temperatures. Of such highly stressed (mechanically and thermally) parts, those that suffer greatest wear or damage are the stationary, feedstock-engaging parts of, or associated with, said stationary shoe member, particularly on said abutment member, said die member and the stationary parts that support those items.

For the convenience of readily making good worn or damaged surfaces or parts, the abutment member, and the die member and its supporting parts are made as separate replaceable items which are rigidly but removably secured in the stationary shoe member.

In order to reduce the temperature at which those replaceable items operate, such items have been provided with internal cooling passages through which cooling water has been circulated. However, such cooling measures have not been very effective, for the reasons that (a) the small sizes of those items and the high mechanical loads to which they are subjected have severly restricted both the sizes of the internal cooling passages and their proximity to the source of heat, so that the cooling water has been unable to extract heat at an adequate rate, and (b) the materials used for such small items (e.g. high-speed tool steels) have relatively poor heat transmission properties.

As a consequence of the low dissipation of heat by the cooling water, plastic flow of the tip of the abutment member, at its free end adjoining the bottom of the groove in the wheel member, has been experienced, due to the excessive tip temperature reached. This has severely limited the life of the abutment member, and the running time of the apparatus between successive occasions when the abutment member has to be replaced. This in turn has led to a reduction in the quantity of the output extrusion product produced, due to the downtime during which the apparatus cannot be operated.

Also, with prolonged use, there has been the risk that the extrusion die may overheat to a temperature at which its mechanical strength is impaired, with the consequent risk of deformation and/or increased wear of the die.

After experimentation with various different arrangements of internal cooling passages, particularly in the abutment member, highly satisfactory results have now been achieved by means of an entirely different arrangement for cooling the abutment member.

DISCLOSURE OF INVENTION

According to the present invention, in a continuous extrusion apparatus of the kind referred to above in the first paragraph of this description, a jet of cooling fluid is directed from a nozzle directly on to the abutment tip portion from a rearward position disposed downstream of the abutment member (i.e. on the side thereof remote from the slug of compressed metal which lies against its upstream or front face). This jet is thus directed at the parts of the abutment member near which most of the frictional heat is generated, so that the cooling fluid is caused to flow directly over and in contact with those parts of the abutment member which would otherwise reach the greatest operating temperatures. With such an arrangement, there is no need to provide in the abutment member internal cooling passages, so that the ability of that member to withstand the high mechanical loads imposed on it is not impaired. Moreover, much less reliance is placed upon the heat transmission properties of the material from which the abutment member is made.

Advantageously, the jet of cooling fluid is also caused to flow partly over an external, peripheral cooling surface of the wheel member, which cooling surface is exposed for such cooling immediately downstream of the abutment member; and also, if desired, to flow partly over an abutment supporting member which is disposed downstream of the abutment member and which supports the abutment member against said extrusion pressure developed upstream thereof.

Preferably, the cooling fluid jet shrouds the abutment supporting member and the abutment member with cooling fluid.

The flow of cooling fluid over the said external cooling surface of the wheel member serves to extract heat carried past the abutment member by wheel rotation, and by thermal conduction through the materials of the wheel member.

Preferably, the wheel member incorporates concentrically therein an annular, thermally-conductive band of a metal having good heat absorption and transmission properties, said band being in good driven relationship with the parts of the wheel member which bound and define the said circumferential groove, and said band serving to absorb heat generated in the extrusion zone immediately upstream of the abutment member and to transmit it to a cooling zone immediately downstream of the abutment member for absorption there by said cooling fluid.

According to another preferred feature of the present invention, where the feedstock inlet means comprises means for admitting feedstock in comminuted or particulate form, cooling fluid may also be admitted to said passageway at or near the said inlet end thereof, or additionally or alternatively as desired, at a position intermediate said inlet and outlet ends thereof, at which position said feedstock in said passageway substantially fills said passageway, but is not fully compacted therein.

Highly satisfactory operation of a continuous extrusion apparatus has been achieved after adopting this method of cooling the abutment member and other parts of the apparatus that lie adjacent thereto, and for periods substantially greater than those achieved with those prior abutment cooling arrangments involving the use of internal cooling passages.

According to a second aspect of the present invention, a method of operating an apparatus as set out in the first paragraph of this description comprises:

(i) rotating said wheel member at a substantially constant speed:

(ii) supplying a feedstock to said inlet end of said passageway at a rate sufficient to extrude a continuous extrusion product through said extrusion die orifice; and (iii) directing a cooling fluid at an external cooling surface of at least said abutment member, which cooling surface is exposed at and is accessible from the downstream side of said abutment member.

Preferably, a said cooling fluid is also caused to flow partly over an external, peripheral cooling surface of the wheel member, which cooling surface is exposed for such cooling immediately downstream of the abutment member; and also, if desired, to flow partly over an abutment supporting member which is disposed downstream of the abutment member and supports the abutment member against said extrusion pressure developed upstream thereof.

A continuous extrusion apparatus according to the present invention may, if desired, be used in conjunction with an extrusion product treatment apparatus to form a continuous extrusion system, in which system the hot continuous extrusion product issuing from the said extrusion apparatus is received by and treated in said treatment apparatus so as to change one or more predetermined characteristics thereof (e.g. its transverse cross-sectional size or shape) in a desired way before said product is passed to a product collection and storage means. Such post-extrusion treatment may be carried out whilst the continuous extrusion product is still hot from the work done on it during the extrusion process.

Such a treatment apparatus may comprise an extrusion product treatment means through which said extrusion product is to be threaded and drawn under tension from said extrusion apparatus, and tensioning means for drawing said extrusion product continuously through said treatment means from said extrusion apparatus as it emerges therefrom. Said treatment means may comprise, for example, a die or other means for changing the size and/or shape of the transverse cross-section of the extrusion product.

In operating such a product treatment apparatus, great care has to be exercised so as to ensure that the tension applied to the treated product emerging from the treatment means does not increase to a level at which the tension consequently induced in the extrusion product as it emerges from the extrusion apparatus is sufficient to break or otherwise impair the properties of the extrusion product entering the treatment means. Control difficulties can arise since, in particular, the yield stress of the hot extrusion product is variable in dependence upon the temperature at which the extrusion product emerges from the extrusion apparatus, which temperature is itself dependent upon the rate at which the extrusion product issues from the extrusion apparatus, and the general operating temperature of the extrusion apparatus.

According to one further, subsidiary aspect of the present invention, there is provided in such a continuous extrusion system:

(a) a temperature sensing means arranged to sense the temperature of the extrusion product as it leaves the continuous extrusion apparatus and to provide a temperature reference signal dependent upon the sensed temperature of the extrusion product;

(b) a tension sensing means arranged to sense the tension in the length of the extrusion product extending between the extrusion apparatus and the treatment means, and to provide a tension feedback signal dependent upon the sensed tension in that length of the extrusion product; and (c) a control apparatus arranged for controlling the said tensioning means, which control apparatus is responsive to said temperature reference signal and said tension feedback signal and is arranged to control said tensioning means automatically in a manner such that the sensed tension in said length of said extrusion product does not exceed a predetermined safe value which is less than the yield stress tension of said extrusion product at the sensed temperature at which the extrusion product leaves the extrusion apparatus.

According to yet another aspect of the present invention, there is provided a method of treating a continuous metal extrusion product issuing from a continuous extrusion apparatus, which method includes the steps of:

(i) threading said extrusion product issuing from a said extrusion apparatus through an extrusion product treatment means;

(ii) continuously applying a tension to said extrusion product as it emerges from said treatment means whereby to draw said extrusion product through said treatment means, and thereby to induce a tension in the length of said extrusion product currently extending between said extrusion apparatus and said treatment means;

(iii) sensing the temperature of said extrusion product as it leaves said extrusion apparatus, and producing a temperature reference signal which is dependent on the sensed temperature;

(iv) sensing the tension in the said length of said extrusion product, and producing a tension feedback signal which is dependent on the sensed tension;

(v) converting said temperature reference signal into a tension reference signal in accordance with a predetermined function relating the value of the said sensed temperature and the value of a safe tension which can be induced in said length of said extrusion product without exceeding the yield stress for said product at the sensed temperature;

(iv) comparing said tension feedback signal with said tension reference signal, and producing therefrom a difference signal dependent on the deviation of said tension feedback signal from a value determined by said tension reference signal; and (vii) controlling said tension applied to said extrusion product emerging from said treatment means in dependence upon said difference signal in a manner such as to prevent said sensed tension exceeding a said safe tension value.

According to another subsidiary aspect of the present invention, the said wheel member is provided on each side of said groove with at least one tooth member positioned and disposed so as to intercept during rotation of said wheel member the waste strip being extruded through the said clearance gap at the adjacent side of the groove when that strip has grown sufficient to extend a predetermined distance from said groove, interception of such a waste strip by a said tooth member being effective to break or tear away and hence free a portion of said waste strip from the apparatus.

According to another subsidiary aspect of the present invention, said shoe member portion which extends in a radial direction partly into said groove has its surface which faces the bottom of said groove shaped so that the radial distance of that surface from the bottom surface of said groove (as defined by the said abutment member) decreases progressively towards said outlet end of said passageway, at least over a predetermined zone adjacent said abutment, in which zone said feedstock material is in a fully compacted condition and without any voids.

By this means there is achieved in said zone, when feedstock in loose particulate or comminuted form is supplied to said passageway, a metal flow pattern more closely resembling that achieveable with feedstock in solid form.

Other features and advantages of the present invention will appear from a reading of the description that follows hereafter, and from the claims appended at the end of that description.

BRIEF DESCRIPTION OF DRAWINGS

One continuous extrusion apparatus embodying the present invention will now be described by way of example and with reference to the accompanying diagrammatic drawings in which.

MODES OF CARRYING OUT THE INVENTION

Figure 1:
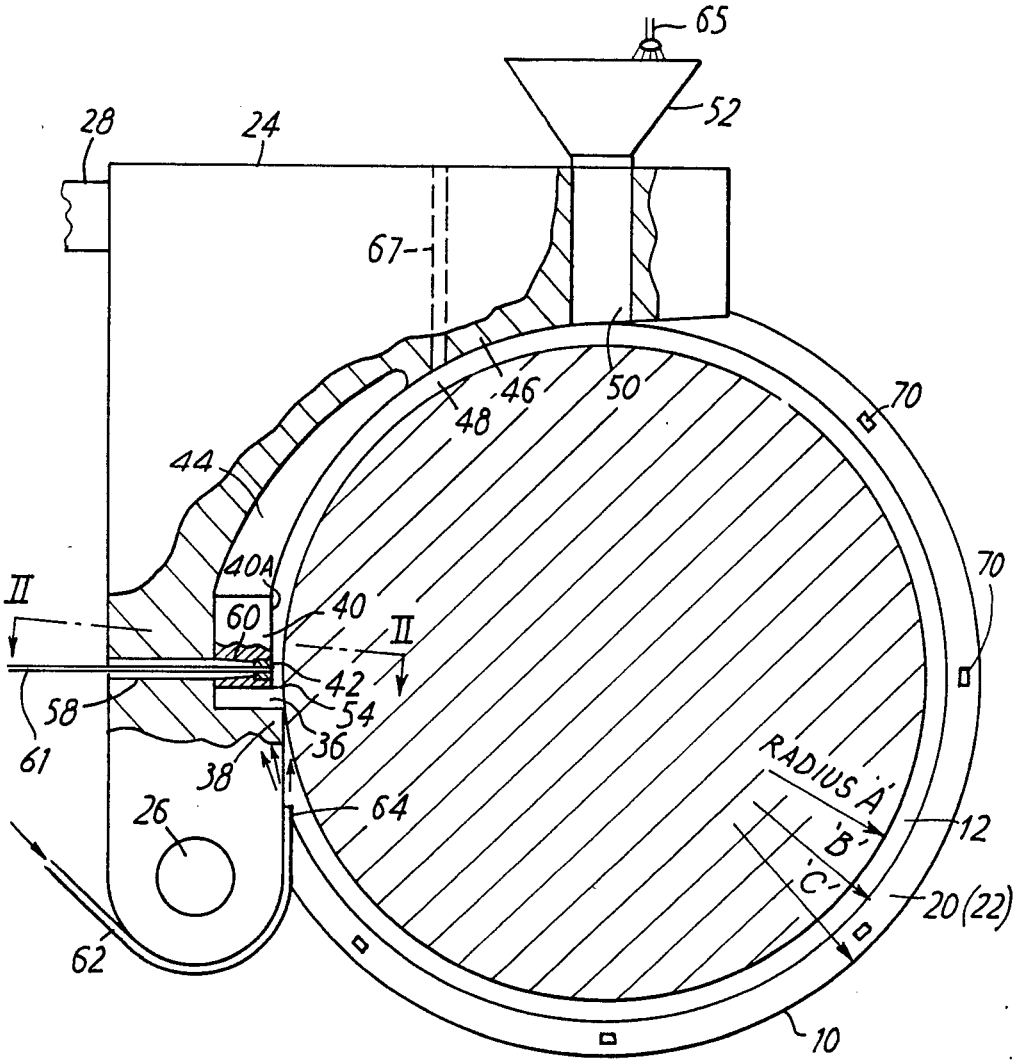
FIG. 1 shows a medial, vertical cross-section taken through the essential working parts of the apparatus, the plane of that section being indicated in FIG. 2 at I—I.
Figure 2:
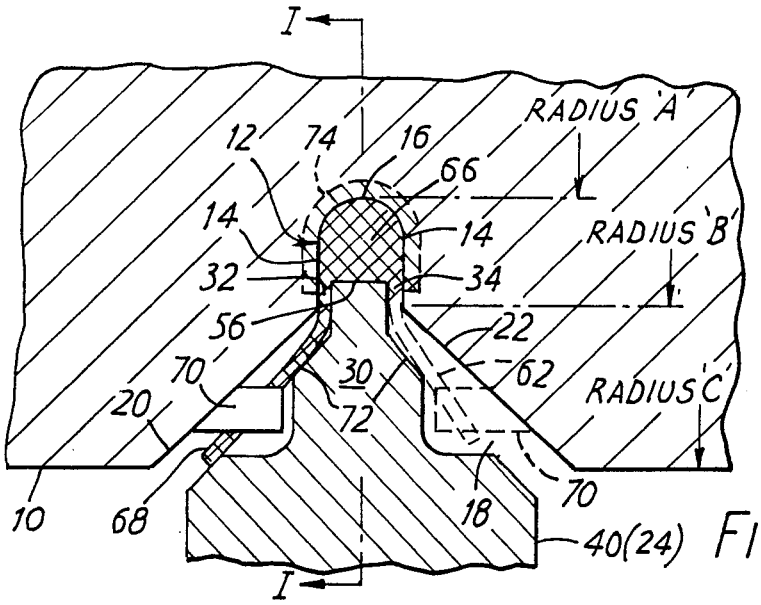
FIG. 2 shows a transverse sectional view taken on the section indicated in FIG. 1 at II—II.

Referring now to FIGS. 1 and 2, the apparatus there shown includes a rotatable wheel member 10 which is carried in bearings (not shown) and coupled through gearing (not shown) to an electric driving motor (not shown) so as to be driven when in operation at a selected speed within the range 0 to 20 RPM (though greater speeds are possible).

The wheel member has formed around its periphery a groove 12 whose radial cross-section is depicted in FIG. 2. The deeper part of the groove has parallel annular sides 14 which merge with a radiused bottom surface 16 of the groove. A convergent mouth part 18 of said groove is defined by oppositely-directed frusto-conical surfaces 20, 22.

A stationary shoe member 24 carried on a lower pivot pin 26 extends around and cooperates closely with approximately one quarter of the periphery of the wheel member 10. The shoe member is retained in its operating position as shown in FIG. 1 by a withdrawable stop member 28.

The shoe member includes centrally (in an axial direction) a circumferentially-extending projecting portion 30 which projects partly into the groove 12 in the wheel member 10 with small axial or transverse clearance gaps 32, 34 on either side. That projecting portion 30 is constituted in part by a series of replaceable inserts, and comprises a radially-directed abutment member 36, an abutment support 38 downstream of the abutment member, a die block 40 (incorporating an extrusion die 42) upstream of the abutment member, and an arcuate wear-resisting member 44 upstream of said die block. Upstream of the member 44 an integral entry part 46 of the shoe member completes an arcuate passageway 48 which extends around the wheel member from a vertically-oriented feedstock inlet passage 50 disposed below a feedstock hopper 52, downstream as far as the front face 54 of the abutment member 36. That passageway has a radial cross-section which in the FIG. 2 is defined by the annular side walls 14 and bottom surface 16 of the groove 12, and the inner surface 56 of the said central portion 30 of the shoe member 24.

The said abutment member 36, die block 40, die 42 and arcuate member 44 are all made of suitably hard, wear-resistant metals, e.g. high-speed tool steels.

The shoe member is provided with an outlet aperture 58 which is aligned with a corresponding aperture 60 formed in the die block 40 and through which the extruded output metal product 61 (e.g. a round wire) from the orifice of the die 42 emerges.

On rotation of the wheel member 10, comminuted feedstock admitted to the inlet end of the said arcuate passageway 48 from the hopper 52 via the inlet passage 50 is carried by the moving groove surfaces of the wheel member in an anti-clockwise direction as seen in FIG. 1 along the length of said arcuate passageway 48, and is agglomerated and compacted to form a solid slug of metal devoid of interstices in the lower section of the passageway adjacent said die block 40. That slug of metal is continuously urged under great pressure against the abutment member by the frictional drag of the moving groove surfaces. That pressure is sufficient to extrude the metal of said slug through the orifice of the extrusion die and thereby provide an extruded output product which issues through the apertures 58 and 60 in the shoe member and die block. In the particular case, the output product comprises a bright copper wire produced from small chopped pieces of wire which constitute the said feedstock.

A water pipe 62 secured around the lower end of the shoe member 24 has an exit nozzle 64 positioned and secured on the side of the shoe member that lies adjacent the wheel member 10. The nozzle is aligned so as, when the pipe is supplied with cooling water, to direct a jet of water directly at the downstream parts of the abutment member where it lies in and abuts the groove 12 in the wheel member 10. Thus, the tip of the free end of the abutment member (where in operation most of the heat is generated) and the adjoining surfaces of the wheel member and groove are directly cooled by the flow thereover of water from the jet directed towards them.

The die block 40 is provided with internal water passages (not shown) and a supply of cooling water for enveloping the output product leaving the die and extruding some of the heat being carried away in that product. But no such internal passages are formed in the abutment member. Thus, the strength of that member is not reduced in the interests of providing internal water cooling for cooling that member.

If desired, the cooling of the apparatus may be enhanced by providing cooling water sprinklers 65 over the hopper 52 so as to feed some cooling water into the said arcuate passageway 48 with the comminuted feedstock.

In the FIG. 2, the slug of compacted metal in the extrusion zone adjacent the die block 40 is indicated at 66. From that metal slug, the output product is extruded through the extrusion die 42 by the pressure in that zone. That pressure also acts to extrude some of the metal through the said axial clearance gaps 32 and 34 between the side walls of the groove and the respective opposing surfaces of the die block and abutment member. That extruded metal gradually builds up in a radial direction to form strips 68 of waste metal or "flash". In order to prevent those waste strips growing too large to handle and control, a plurality of transversely-directed teeth 70 are secured on the divergent walls 20, 22 which constitute the said mouth 18 of the groove 12. Those teeth are uniformly spaced around the wheel member, the teeth on one of the walls being disposed opposite the corresponding teeth on the opposite wall. If desired, the teeth on one wall may alternatively be staggered relative to corresponding teeth on the other wall.

In operation, the inclined surfaces 72 of the die block 40 deflect the extruded waste strips 68 obliquely into the paths of the respective sets of moving teeth 70. Interception of such a waste strip 68 by a moving tooth causes a piece of that strip to be cut or otherwise torn away from the extruded metal in the clearance gap. Thus, such waste extruded strips are removed as soon as they extend radially far enough to be intercepted by a moving tooth. In this way the "flash" is prevented from reaching unmanageable proportions.

The said teeth do not need to be sharp, and can be secured in any satisfactory manner on the wheel member 10, e.g. by welding.

Figure 3:
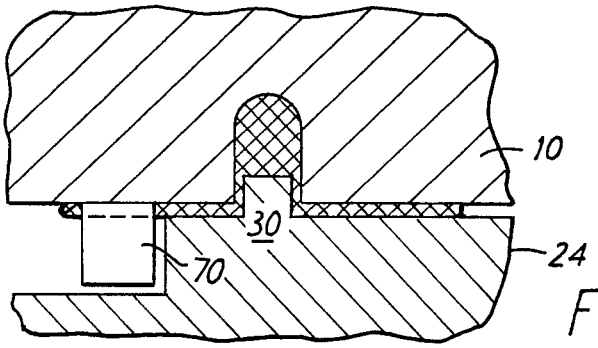
FIGS. 3 and 4 show in sectional views similar to that of FIG. 2 two arrangements which are alternatives to that of FIG. 2.
Figure 4:
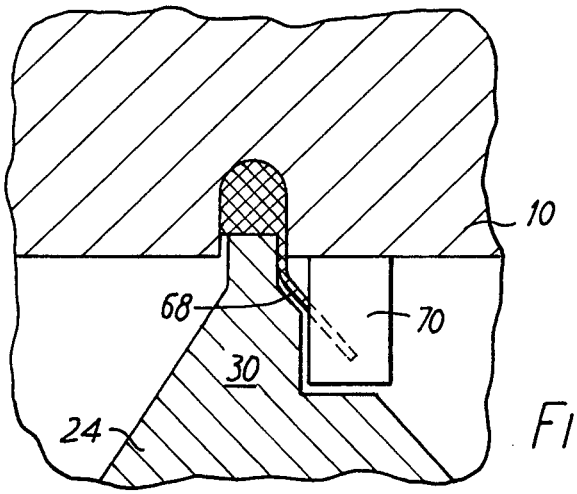

In FIGS. 3 and 4 are shown other teeth fitted in analogous manners to appropriate surfaces of other forms of said wheel member 10.

In those alternative arrangements, the external surfaces of the wheel member 10 cooperate with correspondingly shaped surfaces of the cooperating shoe member 24 whereby to effect control of the flash in a particular desired way. In FIG. 3, the flash is caused to grow in a purely transverse or axial direction, until it is intercepted by a radially projecting tooth, whereupon that piece of flash is torn away from the extruded metal in the associated clearance gap.

In FIG. 4, the flash is caused to grow in an oblique direction (as in the case of FIG. 2), but is intercepted by teeth which project radially from the surface of the wheel member 10.

For various reasons that will apppear later, it may be desirable, or even necessary, to treat the extrusion product (wire 61) issuing from the continuous extrusion apparatus described above in an extrusion product treatment apparatus before passing it to a product collection and storage means. Moreover, it may be desirable or advantageous to treat the extrusion product whilst it still remains hot from the continuous extrusion process in which it was produced.

Such treatment apparatus may, for example, be arranged to provide the extrusion product with a better or different surface finish (for example, a drawn finish), and/or a more uniform external diameter or gauge. Such a treatment apparatus may also be used to provide, at different times, from the same continuous extrusion product, finished products of various different gauges and/or tolerances. For such purposes, the said treatment apparatus may comprise a simple drawing die through which said extrusion product is first threaded and then drawn under tension, to provide a said finished product of desired size, tolerance, and/or quality. The use of such a treatment apparatus to treat the extrusion product would enable the continuous extrusion die 42 of the continuous extrusion apparatus to be retained in service for a longer period before having to be discarded because of the excessive enlargement of its die aperture caused by wear in service. Moreover, such a treatment apparatus may have its die readily and speedily interchanged, whereby to enable an output product of a different gauge, tolerance and/or quality to be produced instead.

Figure 5:
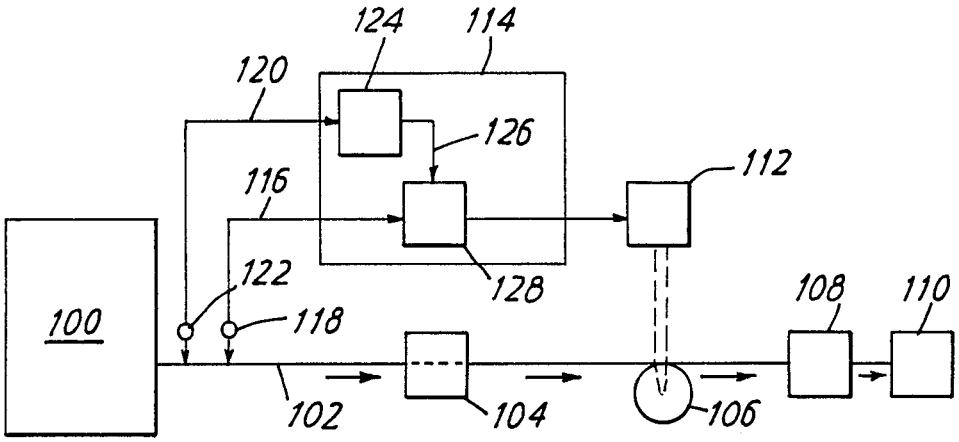
FIG. 5 shows a schematic block diagram of a system embodying the apparatus of the FIGS. 1 and 2.

One example of a continuous extrusion system incorporating a continuous extrusion apparatus and an extrusion product treatment apparatus will now be described with reference to the FIG. 5.

Referring now to the FIG. 5, the system there shown includes at reference 100 a continuous extrusion apparatus as just described above and, if desired, modified as described below, the output copper wire produced by that apparatus being indicated at 102, and being drawn through a sizing die 104 (for reducing its gauge to a desired lower value) by a tensioning pulley device 106 around which the wire passes a plurality of times before passing via an accummulator 108 to a coiler 110.

The pulley device 106 is coupled to the output shaft of an electrical torque motor 112 whose energisation is provided and controlled by a control apparatus 114. The latter is responsive to (a) a first electrical signal 116 derived from a wire tension sensor 118 which engages the wire 102 at a position between the extrusion apparatus 100 and the sizing die 104, and which provides as said first signal an electrical signal dependent on the tension in the wire 102 at the output of the extrusion apparatus 100; and to (b) a second electrical signal 120 derived from a temperature sensor 122 which measures the temperature of the wire 102 as it leaves the extrusion apparatus 100.

The control apparatus 114 incorporates a function generator 124 which is responsive to said second (temperature) signal 120 and provides at its output circuit a third electrical signal representative of the yield stress tension for the particular wire 102 when at the particular temperature represented by the said second (temperature) signal. That third electrical signal 126 is supplied as a reference signal to a comparator 128 (also part of said control apparatus) in which the said first (tension) signal 116 is compared with said third signal (yield stress tension). The output signal of the comparator constitutes the signal for controlling the energisation of the torque motor.

In operation, the torque motor is energised to an extent sufficient to maintain the tension in the wire leaving the extrusion apparatus 100 at a value which lies a predetermined amount below the yield stress tension for the particular wire at the particular temperature at which it leaves the extrusion apparatus.

Whereas in the description above reference has been made to the use of a water jet for cooling the abutment member tip, jets of other cooling liquids (or even cooling gases) could be used instead. Even jets of appropriate liquified gases may be used.

Regarding the flash-removing teeth 70 referred to in the above description, it should be noted that:

(a) the shaping of the leading edge (i.e. the cutting or tearing edge) of each tooth is not critical, as long as the desired flash removal function is fulfilled;

(b) the working clearance between the tip of each tooth 70 and the adjacent opposing surface of the stationary shoe member 24 is not critical, and is typically not greater than 1 to 2 mm, according to the specific design of the apparatus;

(c) the greater the number of teeth spaced around each side of the wheel member 10, the smaller will be the lengths of "flash" removed by each tooth;

(d) the teeth may be made of any suitable material, such as for example, tool steel; and (e) any convenient method of securing the teeth on the wheel member may be used.

The ability of the apparatus to deliver an acceptable output extrusion product from feedstock in loose particulate or communited form is considerably enhanced by causing the radial depth (or height) of the arcuate passageway 48, in a pressure-building zone which lies immediately ahead (i.e. upstream) of the front face 54 of the abutment member 36, to diminish relatively rapidly in a preferred manner in the direction of rotation of the wheel member 10, for example in the manner illustrated in the drawings.

The removable die block 40 is arranged to be circumferentially co-extensive with that zone, and the said progressive reduction of the radial depth of the arcuate passageway is achieved by appropriately shaping the surface 40A of the die block that faces the bottom of the groove 12 in the wheel member 10.

That surface 40A of the die block is preferably shaped in a manner such as to achieve in the said zone, when the apparatus is operating, a feedstock metal flow pattern that closely resembles that which is achieved when using instead feedstock in solid form. In the preferred embodiment illustrated in the drawings, that surface 40A comprises a plane surface which is inclined at a suitable small angle to a tangent to the bottom of the groove 12 at its point of contact with the abutment member 36 at its front face 54.

That angle is ideally set at a value such that the ratio of (a) the area of the abutment member 36 that is exposed to feedstock metal at the extrusion pressure, to (b) the radial cross-sectional area of the passageway 48 at the entry end of said zone (i.e. at the radial cross section adjacent the upstream end of the die block 40) is equal to the ratio of (i) the apparent density of the feedstock entering that zone at said entry end thereof, to (ii) the density of the fully-compacted feedstock lying adjacent the front face 54 of the abutment member 36.

In one satisfactory arrangement, the said plane surface 40A of the die block was inclined at an angle such that the said area of the abutment member that is exposed to feedstock metal at the extrusion pressure is equal to one half of the said radial cross-sectional area of the passageway 48 at the entry end of said zone (i.e. at the upstream end of the die block).

If desired, in an alternative embodiment the surface of the die block facing the bottom of the groove 12 may be inclined in the manner referred to above over only a greater part of its circumferential length which extends from the said upstream end of the die block, the part of the die block lying immediately adjacent the front face 54 of the abutment member being provided with a surface that lies parallel (or substantially parallel) with the bottom of the groove 12.

The greater penetration of the die block 40 into the groove 12, which results from the said shaping of the surface 40A referred to above, serves also to offer increased physical resistance to the unwanted extrusion of flash-forming metal through the clearance gaps 32 and 34, so that the amount of feedstock metal going to the formation of such flash is greatly reduced. Moreover, that penetration of the die block into the groove 12 results in reductions in (a) the redundant work done on the feedstock, (b) the amount of flash produced, and (c) the bending amount moment imposed on the abutment member by the metal under pressure. Furthermore, the choice of a plane working surface 40A for the die block reduces the cost of producing that die block.

Whereas in the above description, the wheel member 10 is driven by an electric driving motor, at speeds within the stated range, other like-operating continuous extrusion machines may utilise hydraulic driving means and operate at appropriate running speeds.

As an alternative to introducing additional cooling water into the passageway 48 via the sprinklers 65, hopper 52 and passage 50, such additional cooling water may be introduced into that passageway (for example, via a passage 67 formed in the shoe member 24) at a position at which said passageway is filled with particular feedstock, but at which said particulate feedstock therein is not yet fully compacted.

It is believed that the highly beneficial cooling effects provided by the present invention arise very largely from the fact that the heat absorbed by a part of the wheel member lying temporarily adjacent the hot metal in the confined extrusion zone upstream of the abutment member is conveyed (both by thermal conduction and rotation of the wheel member) from that hot zone to a cooling zone situated downstream of the abutment member, in which cooling zone a copious supply of cooling fluid is caused to flow over relatively large areas of the wheel member passing through that cooling zone so as to extract therefrom a high proportion of the heat absorbed by the wheel member in the hot extrusion zone.

In this cooling zone access to the wheel member is less restricted, and relatively large surfaces of that member are freely available for cooling purposes. This is in direct contrast to the extremely small and confined cooling surfaces that can be provided directly adjacent the extrusion zone in the parts of the said shoe member (i.e. the die block and abutment member) that bound that extrusion zone. As has been mentioned above, the cooling surfaces that can be provided in those parts are severely limited in size by the need to conserve the mechanical strengths of those parts and so enable them to safely withstand the extrusion pressure exerted on them.

The conveying of heat absorbed by the wheel member to said cooling zone can be greatly enhanced by the incorporation in said wheel member of metals having good thermal conductivities and good specific heats (per unit volume). However, since the said wheel member, for reasons of providing adequate mechanical strength, is made of physically strong metals (e.g. tool steels), it has relatively poor heat transmission properties. Thus, the ability of the wheel member to convey heat to said cooling zone can be greatly enhanced by incorporating intimately in said wheel member an annular band of a metal having good thermal absorption and transmission properties, for example, a band of copper.

Such a thermally conductive band may conveniently be constituted by an annular band secured in the periphery of the said wheel member and preferably constituting, at least in part, the part of said wheel member in which the said circumferential groove is formed to provide (with the shoe member) the said passageway (48).

In cases where the extrusion product of the machine is of a metal having suitably good thermal properties, the said thermally conductive band may be composed of the same metal as the extrusion product (e.g. copper).

In other cases, said thermally-conductive band may be embedded in, or be overlaid by, a second annular band, which second band is of the same metal as the extrusion product of the machine and is in contact with the tip portion of the said abutment member, the two bands being of different metals.

Metals which may be used for the said thermally-conductive band are selected to have a higher product of thermal conductivity and specific heat per unit volume than tool steel, and include the following (in decreasing order of said higher product):

Copper, silver, beryllium, gold, aluminium, tungsten, rhodium, iridium, molybdenum, ruthenium, zinc and iron.

The rate at which heat can be conveyed by such a thermally-conductive band from the extrusion zone to the cooling zone is dependent on the radial cross-sectional area of the band, and is increased by increasing that cross-section area. Thus, for a given cross-sectional dimension measured transversely of the circumference of the wheel member, the greater the radial depth of a said band, the greater the rate at which heat will be conveyed to the cooling zone by the wheel member.

Calculations have shown that for a said wheel member having an effective diameter of 233 mm, and a speed of rotation of 10 RPM, and a said thermally-conductive band of copper having a radial cross-section of U-shape, the rate "R" of conveying heat from the extrusion zone to the said cooling zone by the wheel member, by virtue of its rotation alone, varies in the manner shown below with variation of the radial depth or extent to which a said abutment (36) cooperating with the wheel member penetrates into that copper band, that is to say, with variation of the radial thickness "T" of the copper band that remains at the bottom of the said circumferential groove (12). These calculations were based on a said copper band having with the adjacent parts (tool steel) of the wheel member an interface of generally circular configuration as seen in a radial cross section. Hence, the radial cross-sectional area "A" of the copper band varies in a non-linear manner with the said radial thickness "T" of copper at the bottom of said groove (12).

| T (mm) | A (sq. mm) | R (kW) |
|---|---|---|
| 1.0 | 18.0 | 5.1 |
| 1.5 | 22.7 | 6.4 |
| 2.0 | 27.4 | 7.7 |
| 2.5 | 32.1 | 9.1 |
| 3.0 | 36.8 | 10.4 |

In one practical arrangement having such a wheel member and a 2 mm radial thickness T of said copper band at the bottom of said groove (12), when operating at said wheel member speed and extruding copper wire of 1.4 mm diameter at a speed of 150 meters per minute, heat was extracted from the wheel member and abutment member in said cooling zone at a rate of 10 kW by cooling water flowing at as low a rate of 4 liters per minute and providing at the surfaces to be cooled in said cooling zone a jet velocity of approximately 800 meters per minute.

This heat extraction rate indicates that heat was reaching the cooling zone at a rate of some 2.3 kW as a result of the conduction of heat through the said conductive band, the adjacent wheel member parts, and the abutment member, induced by the temperature gradient existing between the extrusion zone and the cooling zone.

This measured rate of extracting heat by the cooling water flowing in the cooling zone compares very favourably with a maximum rate of heat extraction of some 1.9 kW that has been found to be achievable by flowing cooling water in the prior art manner through internal cooling passages formed in the abutment member.

Figure 6:
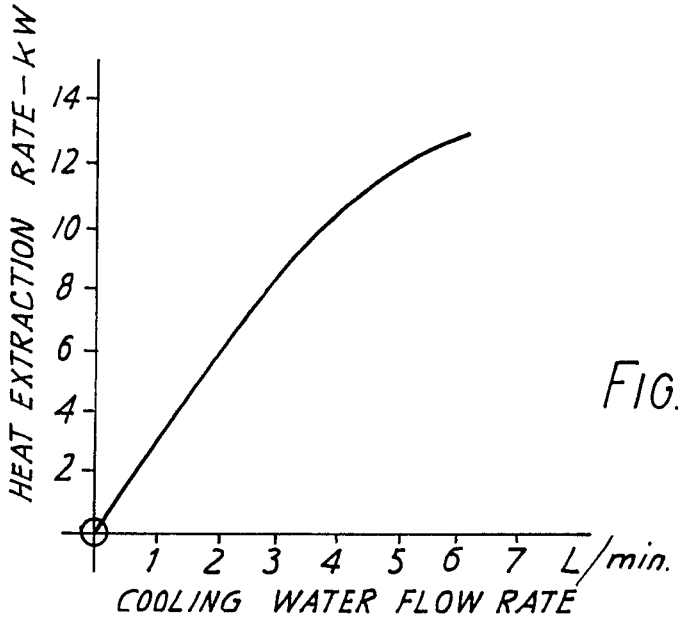
FIG. 6 shows a graph depicting the variation of a heat extraction rate with variation of a cooling water flow rate, as obtained from tests on one apparatus according to the present invention.

FIG. 6 shows the way in which the rate of extracting heat from the wheel member and abutment member in said cooling zone was found to vary with variation of the rate of flow of the cooling water supplied to that zone.

Figure 10:
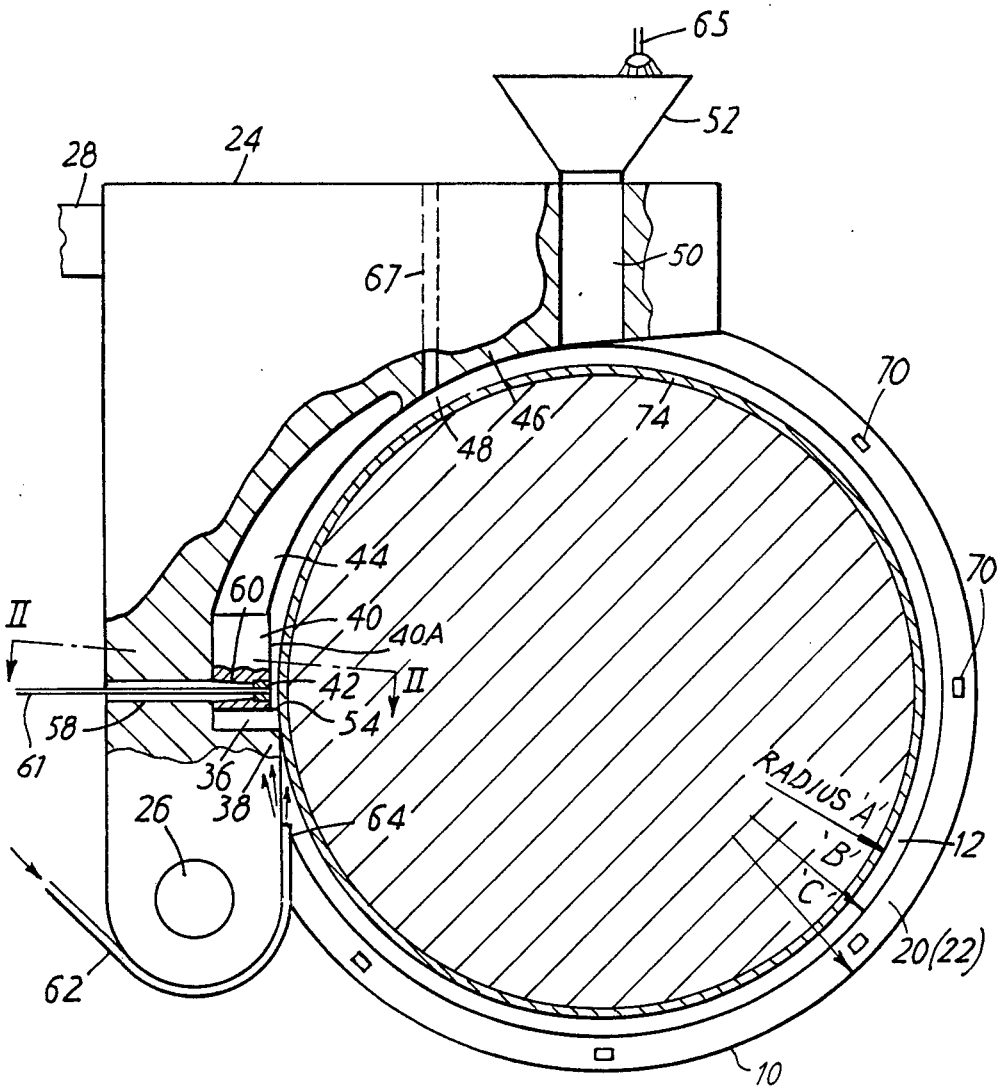
FIG. 10 shows, in a view similar to that of FIG. 1, a modified form of the apparatus shown in the FIGS. 1 and 2.

The extrusion machine described above with reference to the drawings was equipped for the practical tests with a said thermally-conductive band of copper, which band is shown at reference 74 in FIG. 10, and indicated, for convenience only, in dotted-line form in FIG. 2. (It should be noted that FIG. 2 also depicts, when the copper band 74 is represented in full-line form, the transverse sectional view taken on the section indicated in FIG. 10 at II—II.) As will be understood from reference 74 in FIG. 2, the said copper band had a radial cross section of U-shape, which band lined the rounded bottom 16 of the circumferential groove 12 and extended part-way up the parallel side walls of that groove.

Figure 7:
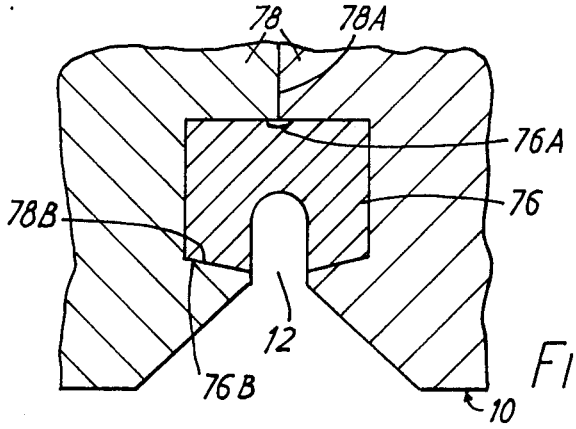

FIG. 7 shows in a view similar to that of FIG. 2 a modification of the wheel member 10. In that modification, a solid annular band 76 of copper having a substantially rectangular radial cross-section is mounted in and clamped securely between cooperating steel cheek members 78 of said wheel member, so as to be driven by said cheek members when a driving shaft on which said cheek members are carried is driven by said driving motor. The band 76 has, at least initially, a small internal groove 76A spanning the tight joint 78A between the two cheek members 78. That groove prevents the entry betwen those cheek members of any of the metal of said band 76 during assembly of the wheel member 10. Complementary frusto-conical surfaces 76B and 78B on said band and cheek members respectively permit easier assembly and disassembly of those parts of the wheel member 10.

The circumferential groove 12, is formed in the copper band by pivotally advancing the shoe member 24 about its pivot pin 26 towards the periphery of the rotating wheel member 10, as as to bring the tip of the abutment member 36 into contact with the copper band, and thereby cause it to machine the copper band progressively deeper to form said groove 12 therein.

Figure 8:
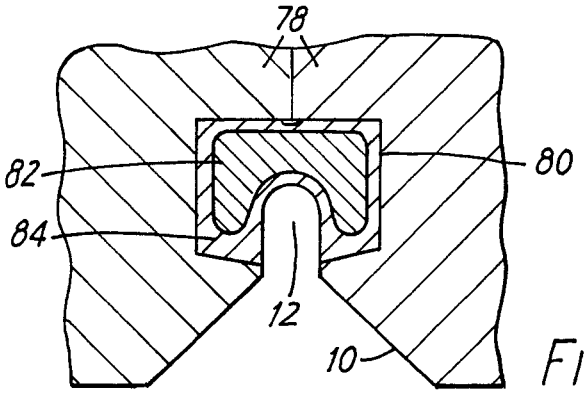

FIG. 8 shows an alternative form of said modification of FIG. 7, in which alternative the thermally-conductive band comprises instead a composite annular band 80 in which an inner core 82 of a metal (such as copper) having good thermal properties is encased in and in good thermal relationship with a sheath 84 of a metal (for example, zinc) which is the same as that to be extruded by the machine.

Figure 9:
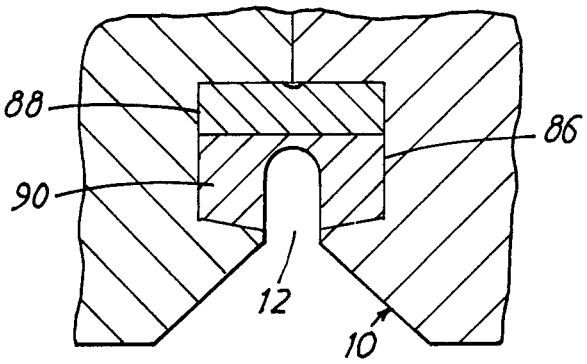
FIGS. 7 to 9 show, in views similar to that of FIG. 2, various modified forms of a wheel member incorporated in said apparatus.

FIG. 9 shows a further alternative form of said modification of FIG. 7, in which alternative the thermally-conductive band comprises instead a composite band 86 in which a radially-inner annular part 88 thereof is made of a metal (such as copper) having good thermal properties and is encircled, in good thermal relationship, by a radially-outer annular part 90 of a metal which is the same as that to be extruded by the machine. Said circumferential groove is machined by said abutment member wholly within said radially-outer part 90 of said band.

Metals which can be extruded by extrusion machines as described above include:

Copper and its alloys, aluminium and its alloys, zinc, silver, and gold.

It should be noted that various aspects of the present disclosure which are not referred to in the claims below have been made the subjects of the respective claims of other, concurrently-filed patent applications which likewise claim priority from the same two UK patent application Nos. 8309836 (filed Apr. 12, 1983) and 8302951 (filed Feb. 3, 1983).

We claim:

1. Apparatus for effecting continuous extrusion of metal from a feedstock in particulate, comminuted or solid form, which apparatus includes:

(a) a rotatable wheel member (10) arranged for rotation when in operation by a driving means, said wheel member having formed peripherally thereon a continuous circumferential groove (12);

(b) a cooperating shoe member (24) which extends circumferentially around a substantial part of the periphery of said wheel member and which has a portion (30) which projects in a radial direction partly into said groove with small working clearance (32,34) from the side walls (14) of said groove, said shoe member portion defining with the walls of said groove an enclosed passageway (48) extending circumferentially of said wheel member;

(c) feedstock inlet means (50,52) disposed at an inlet end of said passageway (48) for enabling feedstock to enter said passageway at said inlet end whereby to be engaged and carried frictionally by said wheel member, when rotating, towards the opposite, outlet end of said passageway;

(d) an abutment member (36) carried on said shoe member (24) and projecting radially into said passageway (48) at said outlet end thereof so as to substantially close said passageway at that end and thereby impede the passage of feedstock frictionally carried in said groove (12) by said wheel member, thus creating an extrusion pressure in said passageway at said outlet end thereof;

(e) a die member (40,42) carried on said shoe member and having a die orifice opening (42) from said passageway (48) at said outlet end thereof, through which orifice feedstock carried in said groove (12) and frictionally compressed by rotation of said wheel member (10), when driven, is compressed and extruded in continuous form, to exit from said shoe member (24) via an outlet aperture (60,58); and (f) cooling means (62,64) disposed immediately downstream of said abutment member and arranged for connection, when the apparatus is in operation, to a source of cooling fluid under pressure, said cooling means being arranged to direct cooling fluid from said source at an external cooling surface of at least said abutment member (36), which cooling surface is exposed for cooling at and accessible from the downstream side of said abutment member.

2. Apparatus according to claim 1, wherein said cooling means (62,64) is also arranged to simultaneously direct cooling fluid from said source at an external, peripheral cooling surface of said wheel member (10), which cooling surface is exposed for such cooling immediately downstream of said abutment member (36).

3. Apparatus according to claim 1, wherein said cooling means (62,64) includes a nozzle (64) disposed and arranged to direct a jet of said cooling fluid on to a said cooling surface of said abutment member (36) at its free end, which end lies projecting into said groove (12) on said wheel member (10).

4. Apparatus according to claim 3, wherein said nozzle (64) is disposed and arranged to direct a jet of said cooling fluid partly on to said surface of said abutment member (36) and partly on to external surfaces of said wheel member (10) and groove (12) which lie adjacent said abutment member.

5. Apparatus according to claim 3, wherein said nozzle (64) is disposed and arranged to direct said jet along an exposed surface of an abutment supporting member (38) which is disposed downstream of said abutment member (36) and which supports said abutment member against said extrusion pressure developed upstream thereof, said jet shrouding and cooling said abutment supporting member as well as at least said abutment member.

6. Apparatus according to claim 3, wherein said nozzle (64) is constituted by the open end of a cooling fluid pipe (62) which is secured on said shoe member (24), said pipe being arranged for connection as its other end to a said source of cooling fluid under pressure.

7. Apparatus according to claim 6, wherein said shoe member (24) is pivotally mounted on a transverse pivot pin (26) at a position downstream of said abutment member (36), and is provided with withdrawable retaining means (28) arranged normally to maintain said shoe member in its operating position relative to said wheel member (10), withdrawal of said retaining means freeing said shoe member for pivotal movement relative to said wheel member whereby to give access to said passageway (48) between its said inlet and outlet ends.

8. Apparatus according to claim 1, wherein said wheel member (10) incorporats concentrically therein an annular, thermally-conductive band (FIG. 2, 74) of a metal having good heat absorption and transmission properties, said band being in good driven relationship with the parts of said wheel member (10) which bound and define said circumferential groove (12), and said band serving to absorb heat generated in the extrusion zone immediately upstream of said abutment member (36) and to transmit it to a cooling zone immediately downstream of said abutment member for absorption there by said cooling fluid.

9. Apparatus according to claim 8, wherein said thermally-conductive band (74) constitutes said parts of said wheel member which bound and define said circumferential groove (12), and said band is formed of a metal which is the same as the metal of said feedstock.

10. Apparatus according to claim 8, wherein said thermally-conductive band (FIG. 8, 82) is sheathed in a second annular band (84), which second band constitutes said parts of said wheel member which bound and define said circumferential groove (12), and which second band isolates said thermally-conductive band (82) from said groove and feedstock disposed therein, and is formed of a metal which is the same as the metal of said feedstock, the metal of said thermally-conductive band (82) being different from said metal of said feedstock.

11. Apparatus according to claim 8, wherein said thermally-conductive band (FIG. 9, 88) is overlaid by a second annular band (90), which second band constitutes said parts of said wheel member which bound and define said circumferential groove (12), and which second band (90) isolates said thermally-conductive band (88) from said groove and feedstock disposed therein, and is formed of a metal which is the same as the metal of said feedstock, the metal of said thermally-conductive band (88) being different from said metal of said feedstock.

12. Apparatus according to claim 9, wherein said circumferential groove (12) is formed in a said annular band (FIG. 2, 74: FIG. 7, 76; FIG. 8, 84; FIG. 9, 90) by a machining process in which metal of said band is removed, so as to form said groove (12), by progressively urging said abutment member (36) when carried in said shoe member (24) (or the equivalent thereof) deeper into the metal of said band.

13. Apparatus according to claim 10, wherein said circumferential groove (12) is formed in a said annular band (FIG. 2, 74; FIG. 7, 76; FIG. 8, 84; FIG. 9, 90) by a machining process in which metal of said band is removed, so as to form said groove (12), by progressively urging said abutment member (36) when carried in said shoe member (24) (or the equivalent thereof) deeper into the metal of said band.

14. Apparatus according to claim 11, wherein said circumferential groove (12) is formed in a said annular band (FIG. 2, 74; FIG. 7, 76; FIG. 8, 84; FIG. 9, 90) by a machining process in which metal of said band is removed, so as to form said groove (12), by progressively urging said abutment member (36) when carried in said shoe member (24) (or the equivalent thereof) deeper into the metal of said band.

15. Apparatus according to claim 1, wherein said cooling means also includes cooling fluid admission means (65,67) arranged for admitting cooling fluid from a supply source into said passageway (48) at or near said inlet end thereof.

16. Apparatus according to claim 15, wherein said feedstock inlet means (50, 52) includes means arranged for admitting to said passageway (48) at said inlet end thereof feedstock in particulate or comminuted form only, and wherein said cooling fluid admission means (65) includes means arranged for admitting cooling fluid into said passageway with said particulate or comminuted feedstock at said inlet end.

17. Apparatus according to claim 15, wherein said feedstock inlet means (50,52) includes means arranged for admitting to said passageway (48) at said inlet end thereof feedstock in particulate or comminuted form only, and wherein said cooling fluid admission means includes a fluid duct (67) disposed in and passing through said shoe member, said duct being disposed and arranged to admit cooling fluid from a said source via said shoe member projecting portion (30) into said passageway (48) at a position intermediate said inlet and outlet ends thereof, at which position said feedstock in said passageway substantially fills said passageway but is not fully compacted therein.

18. A method of operating an apparatus for effecting continuous extrusion of metal from a feedstock in particulate, comminuted or solid form, which apparatus includes:

(a) a rotatable wheel member (10) arranged for rotation when in operation by a driving means, said wheel member having formed peripherally thereon a continuous circumferential groove (12);

(b) a cooperating shoe member (24) which extends circumferentially around a substantial part of the periphery of said wheel member and which has a portion (30) which projects in a radial direction partly into said groove with small transverse working clearance (32,34) from the side walls (14) of said groove, said shoe member portion defining with the walls of said groove an enclosed passageway (48) extending circumferentially of said wheel member;

(c) feedstock inlet means (50,52) disposed at an inlet end of said passageway (48) for enabling feedstock to enter said passageway at said inlet end whereby to be engaged and carried frictionally by said wheel member, when rotating, towards the opposite, outlet end of said passageway;

(d) an abutment member (36) carried on said shoe member (24) and projecting radially into said passageway (48) at said outlet end thereof so as to substantially close said passageway at that end and thereby impede the passage of feedstock frictionally carried in said groove (12) by said wheel member, thus creating an extrusion pressure in said passageway at said outlet end thereof; and (e) a die member (40,42) carried on said shoe membr and having a die orifice (42) opening from said passageway (48) at said outlet end thereof, through which orifice feedstock carried in said groove (12) and frictionally compressed by rotation of said wheel member (10), when driven, is compressed and extruded in continuous form, to exit from said shoe member (24) via an outlet aperture (60,58); said method comprising:

(i) rotating said wheel member (10) at a substantially constant speed;

(ii) supplying a feedstock to said inlet end of said passageway (48) at a rate sufficient to extrude a continuous extrusion product through said extrusion die orifice (42); and (iii) directing a cooling fluid at an external cooling surface of at least said abutment member (36), which cooling surface is exposed at and is accessible from the downstream side of said abutment member.

19. A method according to claim 18, wherein a said cooling fluid is also directed simultaneously at an external, peripheral cooling surface of said wheel member (10), which cooling surface adjoins said abutment member (36) and is exposed for such cooling immediately downstream of said abutment member.

20. A method according to claim 18, wherein said cooling fluid is directed along an exposed surface of an abutment supporting member (38) which is disposed downstream of said abutment member (36) and which supports said abutment member against said extrusion pressure developed upstream thereof, said cooling fluid shrouding and cooling said abutment supporting member (38) as well as at least said abutment member (36).

21. A method according to claim 19, wherein cooling fluid is admitted into said passageway (48) at or near said inlet end thereof.

22. A method according to claim 21, wherein said feedstock is in particulate or comminuted form only, and wherein said cooling fluid is admitted into said passageway (48) with said particulate or comminuted feedstock at said inlet end of said passageway.

23. A method according to claim 21, wherein said feedstock is in particulate or comminuted form only, and wherein said cooling fluid is admitted into said passageway (48) at a position intermediate said inlet and outlet ends thereof, at which position said feedstock in said passageway substantially fills said passageway but is not fully compacted therein.

24. A continuous extrusion system comprising:

(a) a continuous extrusion apparatus (100) according to claim 1 for producing a continuous metal extrusion product (102);

(b) an extrusion product treatment means (104) through which said extrusion product is to be threaded and drawn under tension from said extrusion apparatus, whereby to effect a desired change in one or more predetermined characteristics of said extrusion product;

(c) a tensioning means (106,112) arranged to apply, when the system is in operation, a tension to said extrusion product leaving said treatment means whereby to continuously draw said extrusion product through said treatment means;

(d) a temperature sensing means (122) arranged to sense the temperature of the extrusion product as it leaves the continuous extrusion apparatus and to provide a temperature reference signal dependent upon the sensed temperature of the extrusion product;

(e) a tension sensing means (118) arranged to sense the tension in the length of the extrusion product extending between the extrusion apparatus and the treatment means, and to provide a tension feedback signal dependent upon the sensed tension in that length of the extrusion product; and (f) a control apparatus (128) arranged for controlling the tensioning means, which control apparatus is responsive to said temperature reference signal and said tension feedback signal and is arranged to control said tensioning means automatically in a manner such that the sensed tension in said length of said extrusion product does not exceed a predetermined safe value which is less than the yield stress tension of said extrusion product at the sensed temperture at which the extrusion product leaves the extrusion apparatus.

25. A system according to claim 24, wherein said control apparatus includes:

(i) a function generator (124) responsive to said temperature reference signal and arranged to produce in response thereto a tension reference signal representative of the yield stress tension for said extrusion product at said sensed temperature; and (ii) comparison means (128) responsive differentially to said tension reference and feedback signals, and arranged to produce in response thereto a control signal for controlling said tensioning means in dependence upon the difference of said tension reference and feedback signals.

26. A system according to claim 25, wherein said tensioning means incorporates an electrically energised torque motor, and said control apparatus is arranged to vary the electrical energisation of said torque motor.

27. A method of treating a continuous metal extrusion product (102) issuing from a continuous extrusion product (100) according to claim 1, which method includes the steps of:

(i) threading said extrusion product issuing from a said extrusion apparatus through an extrusion product treatment means (104);

(ii) continuously applying a tension to said extrusion product as it emerges from said treatment means whereby to draw said extrusion product through said treatment means, and thereby to induce a tension in the length of said extrusion product currently extending between said extrusion apparatus and said treatment means;

(ii) sensing the temperature of said extrusion product as it leaves said extrusion apparatus, and producing a temperature reference signal (120) which is dependent on the sensed temperature;

(iv) sensing the tension in the said length of said extrusion product, and producing a tension feedback signal (116) which is dependent on the sensed tension;

(v) converting said temperature reference signal into a tension reference signal (126) in accordance with a predetermined function relating the value of the said sensed temperature and the value of a safe tension which can be induced in said length of said extrusion product without exceeding the yield stress for said product at the sensed temperature;

(vi) comparing said tension feedback signal with said tension reference signal, and producing therefrom a difference signal dependent on the deviation of said tension feedback signal from a value determined by said tension reference signal; and (vii) controlling said tension applied to said extrusion product emerging from said treatment means in dependence upon said difference signal in a manner such as to prevent said sensed tension exceeding a said safe tension value.

28. A continuous metal extrusion product produced and treated by means of a continuous extrusion system according to claim 24.

29. A continuous metal extrusion product produced and treated by a method according to claim 27.

* * * * *